United States Patent [19]

Bailey et al.

[11] Patent Number: 5,005,881

[45] Date of Patent: Apr. 9, 1991

[54] DOOR LOCKING MECHANISM

[75] Inventors: Kevin L. Bailey, Rolling Meadows; Richard E. D'Hooge, Wood Dale, both of Ill.

[73] Assignee: Rixson-Firemark Inc., Franklin Park, Ill.

[21] Appl. No.: 389,964

[22] Filed: Aug. 7, 1989

[51] Int. Cl.[5] ..... E05C 7/06

[52] U.S. Cl. ..... 297/45; 292/DIG. 21; 292/177

[58] Field of Search ..... 292/DIG. 62, DIG. 21, 292/292, 58, 177, 181, 182, 34, 35, 36, 229, 45, 92

[56] References Cited

U.S. PATENT DOCUMENTS

| | | | |
|---|---|---|---|
| 1,338,713 | 5/1920 | Toney | 292/DIG. 21 X |
| 2,202,916 | 6/1940 | Mussa | 292/177 |
| 2,513,483 | 7/1950 | Hempfling | 292/182 |
| 2,911,249 | 11/1959 | Jewett et al. | 292/92 |
| 3,578,369 | 5/1971 | Coopersmith | 292/58 |
| 3,582,122 | 6/1971 | Foster | 292/DIG. 21 X |
| 4,005,886 | 2/1977 | Lirette | 292/177 |
| 4,099,753 | 7/1978 | Gwozoz et el. | 292/177 |
| 4,445,717 | 5/1984 | Imhoff | 292/177 |
| 4,819,976 | 4/1989 | Bert | 292/48 |

FOREIGN PATENT DOCUMENTS

| | | | |
|---|---|---|---|
| 191850 | 10/1907 | Fed. Rep. of Germany | 292/45 |
| 173655 | 3/1935 | Switzerland | 292/45 |
| 522381 | 6/1940 | United Kingdom | 292/182 |

*Primary Examiner*—Eric K. Nicholson
*Attorney, Agent, or Firm*—Augustus G. Douvas

[57] ABSTRACT

A locking mechanism to be applied to an inactive door of a set of active and inactive double doors coordinated so that the inactive door closes first relative to a frame followed by the closing of the active door. Adjustable drive means is employed capable of either lengthwise contraction upon the application of a force between first and second separated locations on the adjustable drive means exceeding a threshold value, or linear movement without substantial contraction upon the application of a force less than the threshold value. A door-lock actuating element is coupled to the adjustable drive means at the first location. A door-locking element is coupled to the adjustable drive means at the second location. The adjustable drive means, the door-lock actuating element, and the door-locking element are supported at an upper or lower corner of the inactive door. The door-lock actuating element projects into the closing path of the active door to operate the door-lock actuating element and the adjustable drive means to drive forcibly the door-locking element into a locking engagement when the drive means is subjected to less than the threshold force value. The adjustable drive means contracts in response to an obstruction which prevents the door-locking element from locking the door. A fire shield envelopes many of the operating components to prolong the integrity of the locking mechanism.

14 Claims, 4 Drawing Sheets

DOOR LOCKING MECHANISM

This invention relates to a door locking mechanism which is particularly designed for use with a pair of doors whose closing action is coordinated.

BACKGROUND OF THE INVENTION

The closing sequence of a set of double doors is often regulated in the prior art by a door coordinating mechanism. Such a device dictates that a specified one of the doors always closes first followed by the closing of the other door. The first door to close is often termed the "inactive" or "leading" door. The other (or last) door to close is appropriately termed the "active" or "trailing" door.

The prior art discloses automatic locking mechanisms particularly designed for coordinated double doors. For example, U.S. Pat. No. 3,578,369 shows a self-operating extension flush bolt or locking mechanism which is applied to the inactive door of a pair of hinged doors. When the inactive door is in a closed position and the active door is thereafter closed, the active door engages a cam projecting from the inactive door. This engagement action causes a latch bolt to project from a horizontal edge of the door into a strike plate located either in the door header or the door sill.

This patented locking mechanism requires considerable force to operate the bolt, which makes it necessary to use a heavy duty door closer for the active door.

Additionally, if the latch bolt on the inactive door is not aligned with its strike plate when the active door is closed, damage may occur to the locking mechanism.

In order to overcome the above noted problems, U.S. Pat. No. 4,099,753 discloses a locking mechanism that is stated to require less force to operate, and which will not become damaged or cause any damage if the bolt and keeper are not aligned when the doors are closed.

The locking mechanism of U.S. Pat. No. 4,099,753 is nonetheless excessively complicated in that it features a relatively large number of coacting linkages. Moreover, the operative locking movements of the linked parts still require a substantial operating force which does often prevent easy door closing and locking.

SUMMARY OF THE INVENTION

Accordingly, a principal object of this invention is to provide an automatic locking mechanism for a set of coordinated double doors which is less complicated than those of the prior art.

Another object is to provide an automatic locking mechanism for a set of coordinated double doors which requires less force than prior art devices to operate and still effect an easy and secure door lock.

Another object is to provide an automatic locking mechanism for a set of coordinated double doors which will not become damaged or cause any damage if the bolt and its strike plate are not aligned when the doors are closed.

Another object is to provide such a lock which in case of fire will continue to lock the inactive door reliably for a substantial period of time.

A preferred embodiment of the locking mechanism of this invention features a simple reciprocating mechanism which comprises a pair of telescoping tubes which houses a contained compression spring. A door cam is coupled to the end of one of the tubes, and a door-locking bolt to the opposite end of the other tube. When the active door is closed, the door cam drives the tube pair and its encapsulated spring as a single unit to pivot the locking bolt into a locking engagement with its strike plate.

In the event the locking bolt is misaligned with the strike plate, the weak force of the spring enables the pair of tubes to collapse one within another, as a contractible mechanism. Accordingly, in this situation of a misaligned bolt, a non-damaging minimal force is applied to the locking bolt.

Another feature of the invention is directed to a strike mechanism which may be floor mounted. This mechanism employes a pivoting strike flap which essentially closes the strike cavity. The strike flap is pivoted to receive the locking bolt to establish a lock; however, when a lock is not effected the strike flap prevents large foreign objects from entering the strike cavity.

DESCRIPTION OF THE DRAWINGS

In order that all of the structural features for attaining the objects of this invention may be readily understood, reference is made to the drawings in which.

DESCRIPTION OF THE PREFERRED EMBODIMENT

Figure 1:
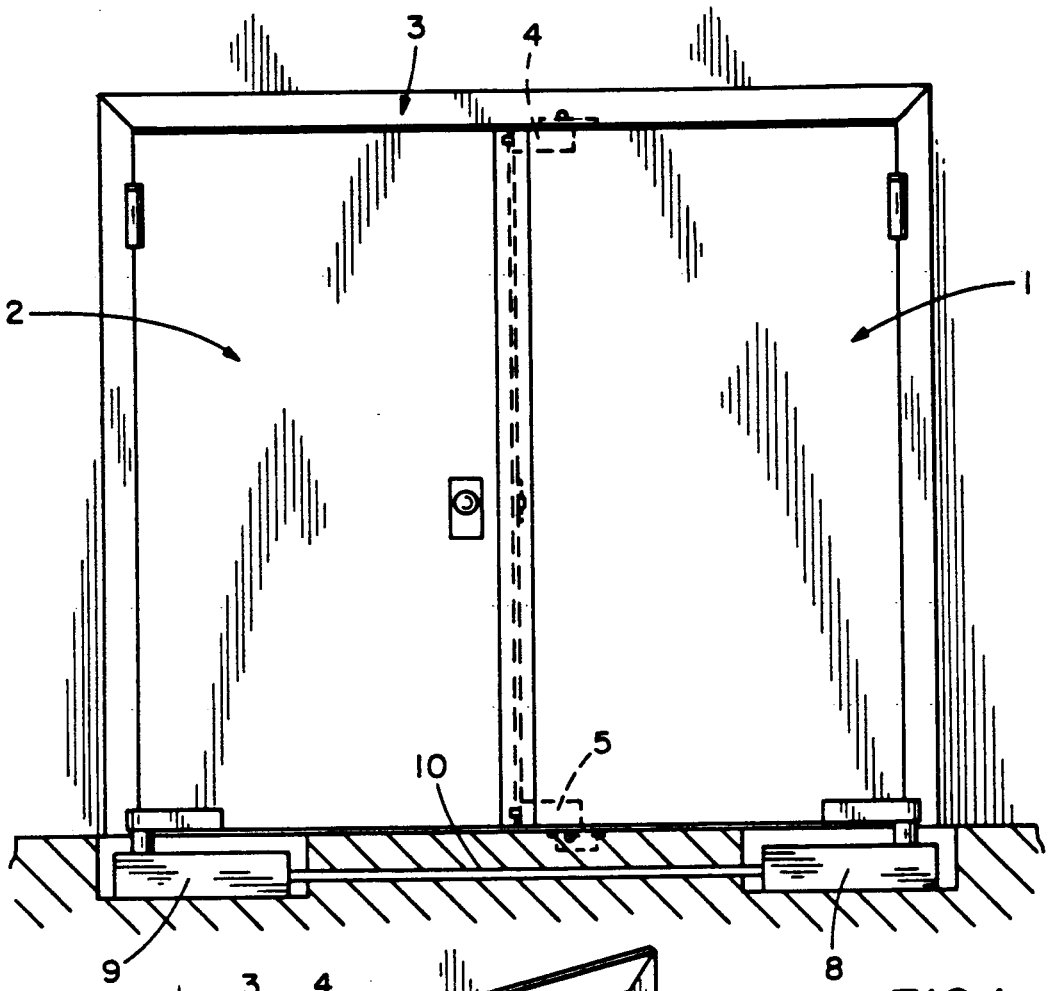
FIG. 1 is a front elevation view, which shows a closed set of double doors whose closing action is coordinated by a pair of hydraulically-linked floor closers, with a door locking mechanism of this invention applied to the top outside corner and also the bottom outside corner of an inactive door.

Referring to the drawings, a pair of hinged doors 1 and 2 are shown (FIG. 1) which close off the double-door opening defined by door frame 3. The closing sequence of both doors is coordinated. Door 1, the first to close (FIG. 2), is commonly referred to as the inactive door; and in that context door 2, the last to close, is referred to as the active door.

This invention relates to the two door locking mechanisms 4 and 5 applied to inactive door 1 and actuated by active door 2 when the latter door is closed by a door closer or manually. The upper and lower corners of inactive door 1 are mortised to provide recesses that receive locking mechanisms 4 and 5. Since the two mechanisms are alike, except for their cooperating strike structures 6 and 7 (FIG. 3), only the lower mechanism 5 will be described in detail because of its more complex strike structure 7.

Figure 2:
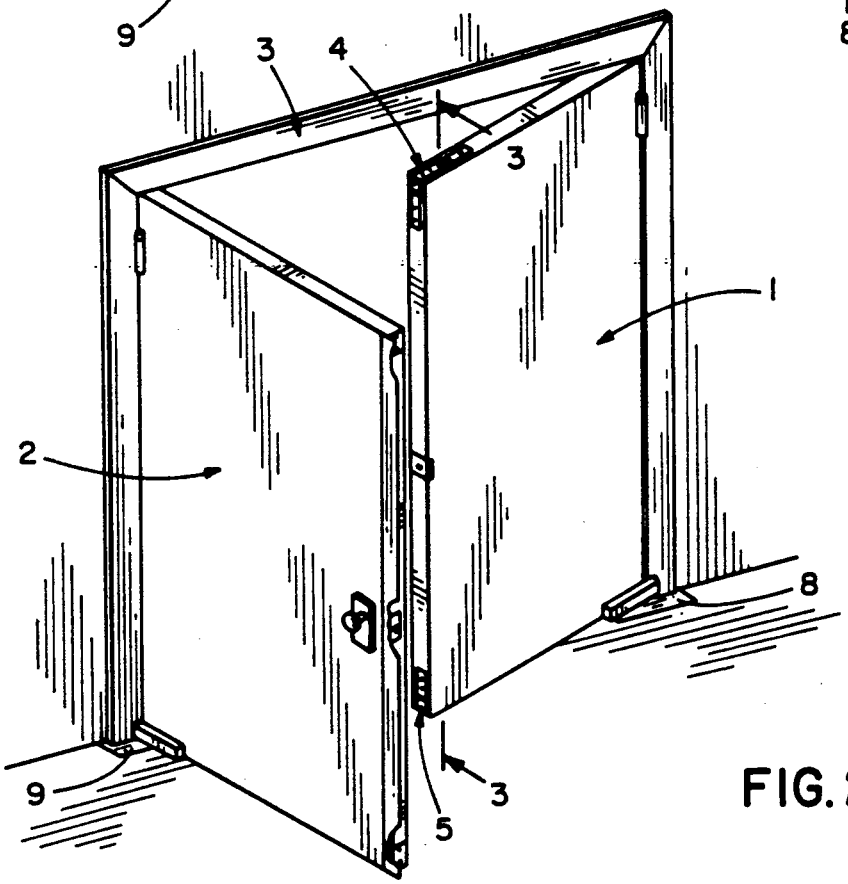
FIG. 2 shows the doors of FIG. 1 in a partially closed position with the active door trailing the inactive door.

Coordinated floor closers 8 and 9 are applied to doors 4 and 5, respectively (FIG. 1). In general, hydraulic control 10 effects sequence control of floor closers 8 and 9 so that inactive door 1 closes first followed by trailing active door 2. Details of the particular coordinated door closers are shown in U.S. Pat. No. 4,663,887 issued May 12, 1987.

General Operation

Figures 3, 4:
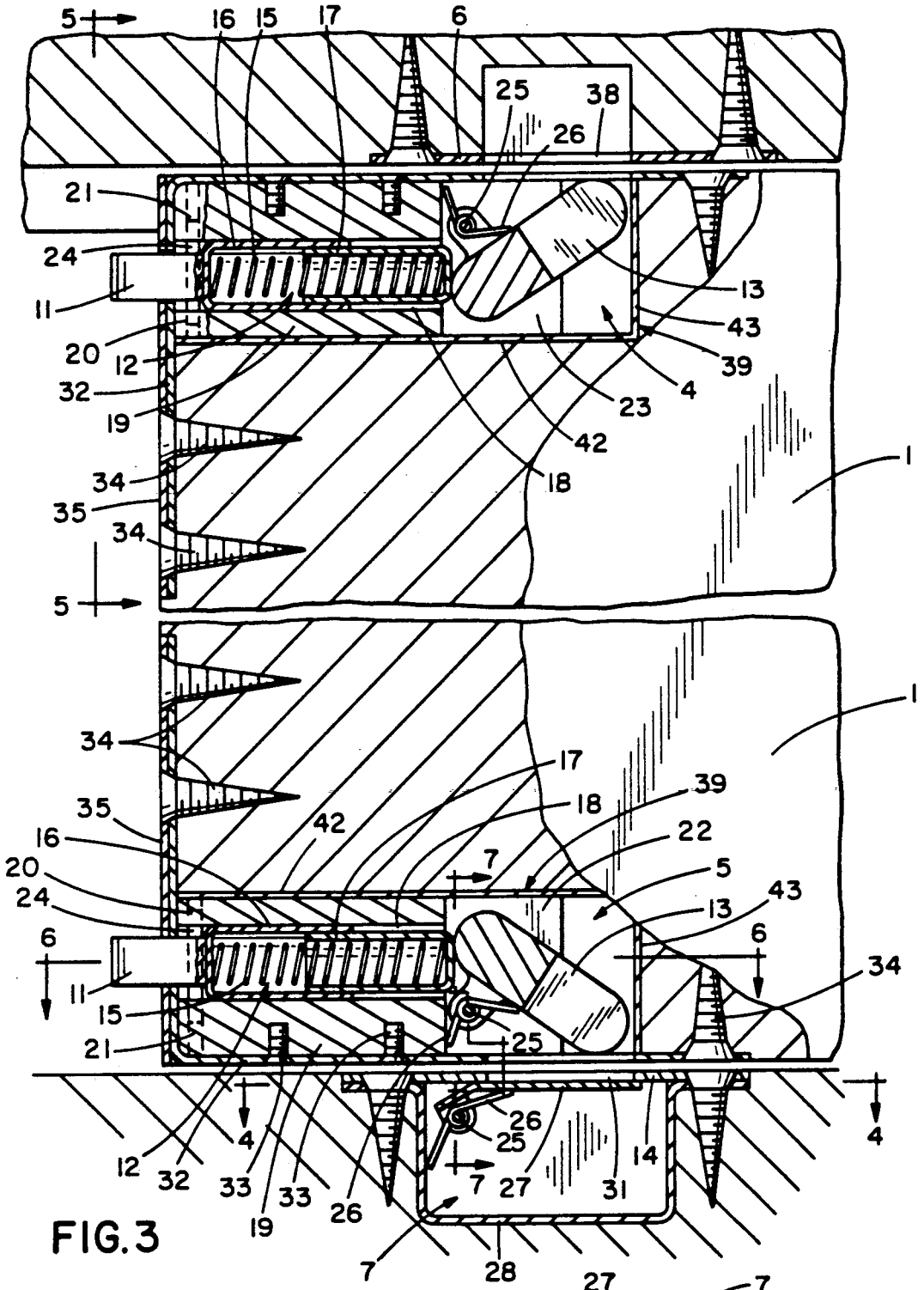
FIG. 3 is a fragmentary section view taken along line 3—3 of FIG. 2 which shows the disposition of the internal structure of both the upper and lower door locking mechanisms and their strike structure with the inactive door in an unlocked condition.
FIG. 4 is a view taken along line 4—4 of FIG. 3 which shows a plan view of the floor-recessed strike assembly.
Figure 5:
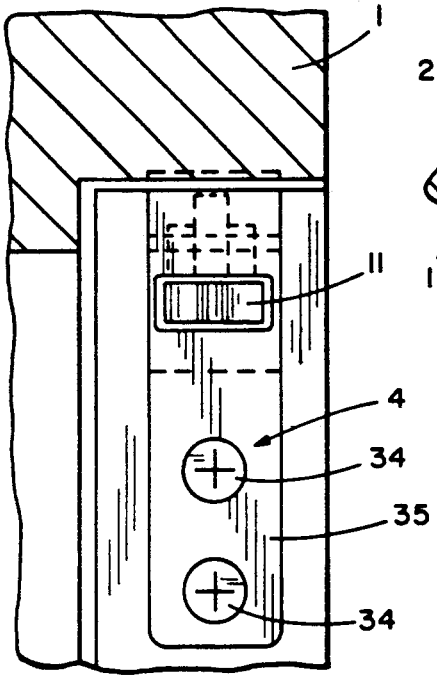
FIG. 5 is an elevation view taken along line 5—5 of FIG. 3 which shows the door cam of the upper door locking mechanism.
Figure 6:
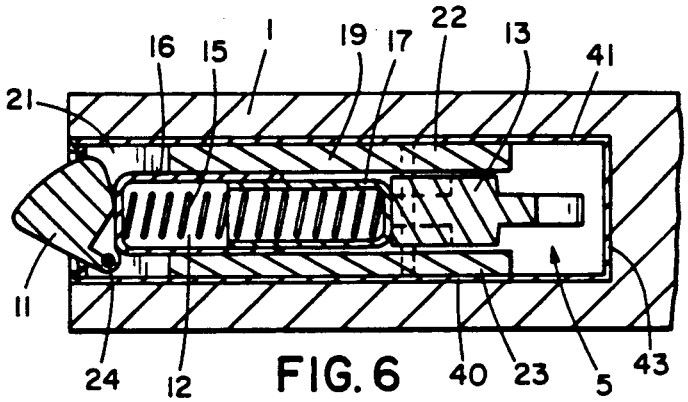
FIG. 6 is a section view taken along line 6—6 of FIG. 3 which shows the disposition of the internal structures of the lower door locking mechanism with the inactive door being in an unlocked condition.
Figure 7:
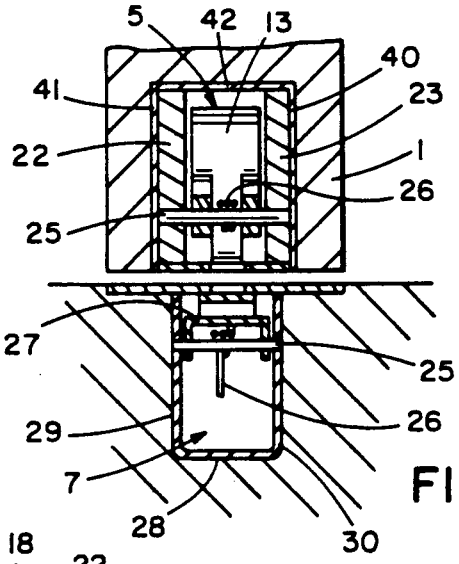
FIG. 7 is a section view taken along line 7—7 of FIG. 3 which shows the locking bolt in an unlocked condition relative the lower strike assembly.
Figure 8:
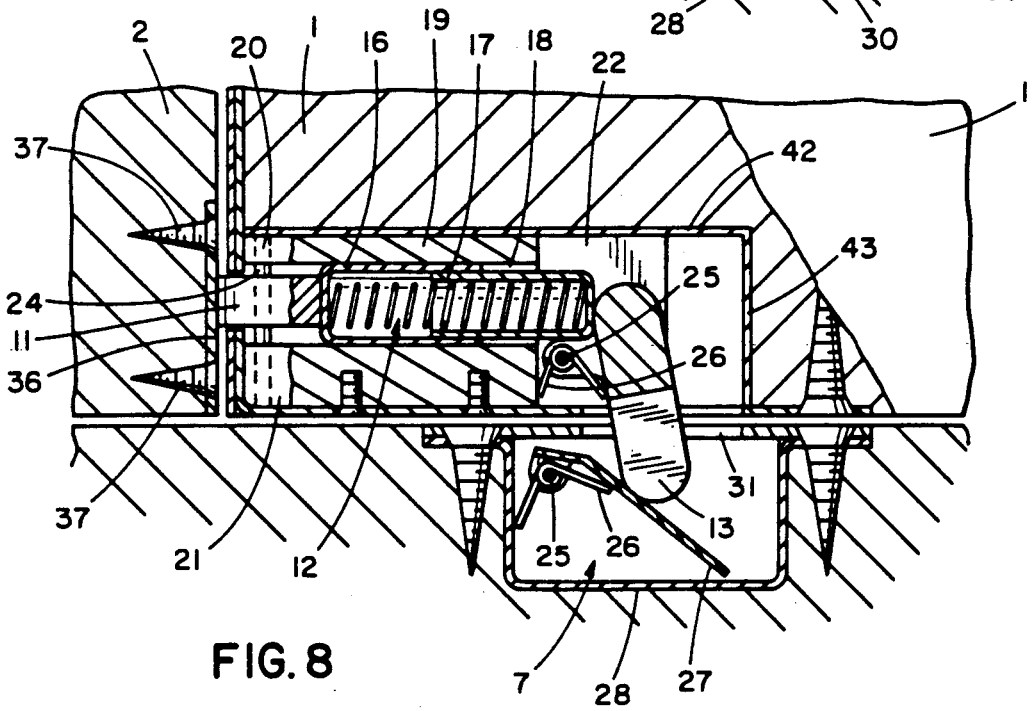
FIG. 8 is a section view which shows the lower door locking mechanism of FIG. 3 in a locking condition with the locking bolt engaging the lower strike assembly.
Figure 9:
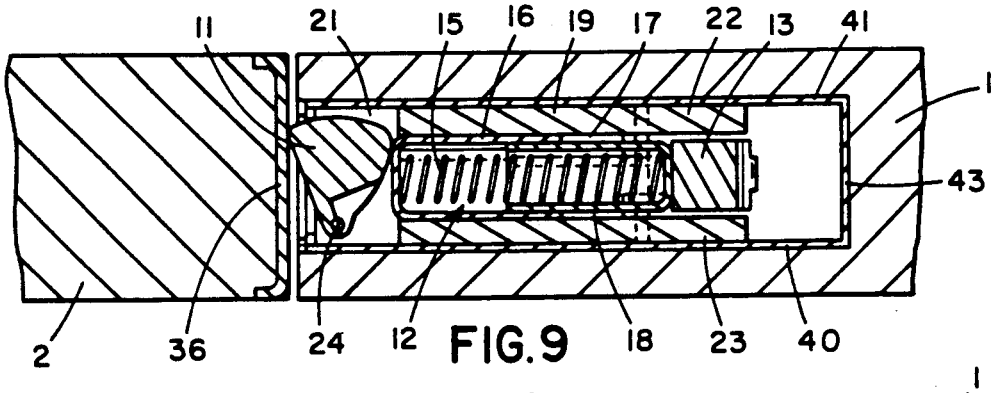
FIG. 9 is a section view which shows the door cam of FIGS. 5 and 6 driven by the active door to effect locking of the inactive door.
Figure 10:
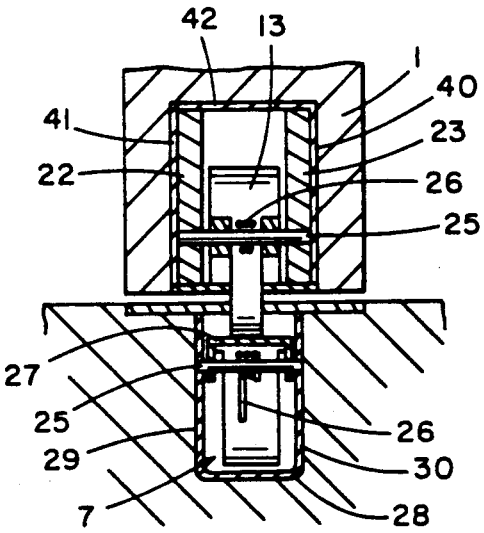
FIG. 10 is a section view related to FIG. 8 which also shows the locking bolt of the lower door locking mechanism in a locking condition.

The principal operating elements of lower door locking mechanism 5 are door cam 11, contractible-reciprocating spring assembly 12, and pivotable locking bolt 13 (FIGS. 3, 6 and 7). In brief summary, when door cam Il is activated by active door 2 and driven inwardly (FIGS. 8, 9 and 10), spring-assembly 11 is driven (without contraction) to the right to pivot locking bolt 13 into locking engagement with lower strike assembly 7. Inactive door 1 is also locked simultaneously by corresponding action which pivots the locking bolt of locking assembly 4 into engagement with its mating strike assembly 6. Thus, inactive door 1 is locked to frame 3 at both its upper and lower edges.

Figure 11:
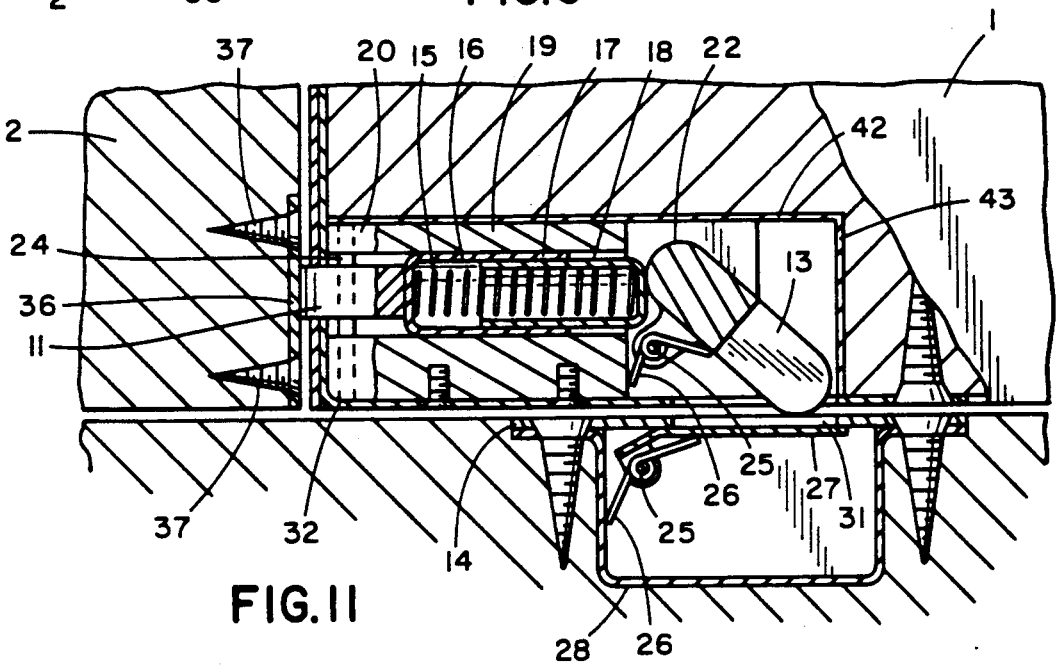
FIG. 11 is a section view of the lower door locking mechanism which shows the misaligned disposition of the locking bolt relative the lower strike assembly when the inactive door is closed.
Figure 12:
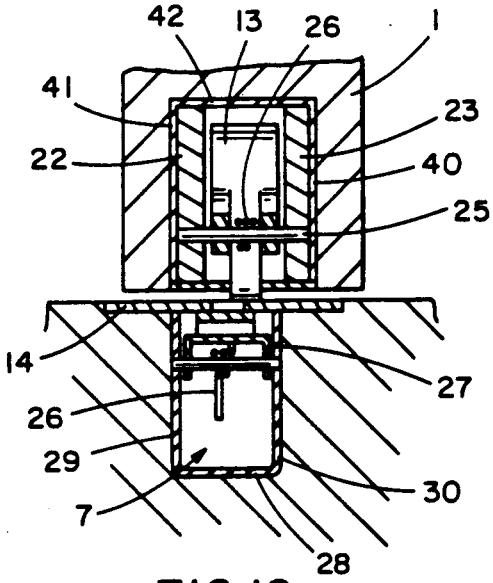
FIG. 12 is a section view related to FIG. 11 which further shows the misalignment condition of FIG. 11.

In the event of misalignment of locking bolt 13 with the opening of its companion strike assembly 6 or 7, the normal pivoting locking movement of bolt 13 is obstructed by lower strike plate 14 (FIGS. 11 and 12) and spring assembly 13 is contracted. This contraction prevents damage to locking mechanism 5. Locking mechanism 4 operates in a similar safeguarding manner.

Detailed Construction

Spring assembly 12 comprises an elongated compression spring 15 confined within two telescoping spring tubes 16 and 17. The internal force exerted by spring 15 acts to extend the overall length of assembly 12. An external force applied to the opposite ends of tubes 16 and 17 will compress spring 15 tending to cause a reduction in the length of assembly 12.

Spring assembly 12 is located loosely within circular bore 18 formed in the central body part of locking mechanism housing 19. Assembly 12 is capable of both contraction lengthwise and reciprocation within bore 18. Housing 19 is formed with a first set of spaced door-cam pivot arms 20 and 21 upon which door cam 11 pivots in a horizontal plane; housing 19 is also formed with a second set of spaced lockingbolt pivot arms 22 and 23 upon which locking bolt 13 pivots in a vertical plane.

Door cam 11 pivots on pin 24, and the cam is normally biased outwardly by a force applied to the cam by spring assembly 12 when doors 1 and 2 do not mate.

In a preferred embodiment, spring assembly 12 has a free length of about 2 inches. A threshold force of about 12.09 pounds is required to initiate the contraction in length. An additional force of about 13.2 pounds is required per inch of contraction. When fully compressed assembly 12 is about 0.778 inches long.

Locking bolt 13 pivots on pin 25, and the bolt is normally biased by torsion spring 26 riding on pin 25 to the retracted position shown in FIG. 3. When door cam 11 is driven inwardly (FIGS. 9 and 10), locking bolt 13 is driven to its door-locking position overcoming the opposing force exerted by torsion spring 26.

Strike structure 7, which cooperates with lower door locking mechanism 5, is formed with a pivoting strike flap 27 (FIGS. 3, 8 and 11), which is located within a flanged floor-recessed cup 28. Pin 25 extends between sidewalls 29 and 30 of cup 28. Torsion spring 26 biases flap 27 against strike plate 14 to close off strike opening 31 located in plate 14. This closing action of strike flap 27 tends to prevent foreign particles from accumulating in the floor recess.

Housing 19 is fixed to L-shaped mounting bracket 32 by screws 33, and the entire unitary assembly is fixed to door 1. The entire door locking mechanism is fixed to inactive door 1 by a set of screws 34. Dress plate 35 covers the vertical face of mounting bracket 32 to improve the appearance of the mortised locking assembly 4 and 5.

Wear plate 36 is fixed to active door 2 by screws 37 opposite door cam 11 to mate with the cam and prevent damaging wear on door 2.

Upper strike plate 6 is formed with a simple rectangular opening 38 which receives upper locking bolt 13. The upper strike plate does not need a strike flap in view of disposition at the top of the door.

A metal fire shield 39 (FIG. 3)houses the internal components of door locking mechanisms 4 and 5. Each fire shield is formed with a pair of spaced sidewalls 40 and 41 which are joined by endwalls 42 and 43. Each fire shield 39 mates with its associated metal bracket 32 to form a closed compartment which serves as a fire shield for the internally housed components which include spring assembly 12. Fire shield 39 prolongs the operational integrity of door locking mechanisms 4 and 5 in case of fire.

It should be understood that the above-described arrangements are merely illustrative of the principles of invention and modifications can be made without departing from the scope of the invention.

What is claimed is:

1. A locking mechanism to be applied to an inactive door of a set of active and inactive double doors co-cordinated so that the inactive door closes first relative to a frame followed by the closing of the active door, comprising adjustable drive means capable of lengthwise contraction along a first axis upon the application of a force between first and second separated locations on the adjustable drive means exceeding a threshold value, a door-lock actuating element coupled to the adjustable drive means at the first location with the door-lock actuating element turning about a second axis different from the first axis, a door-locking element coupled to the adjustable drive means at the second location with the door-locking element turning about a third axis different from the first and second axes, and means adapted to support the adjustable drive means, the door-lock actuating element and the door-locking element at an upper or lower corner of the inactive door with the door-lock actuating element projecting into the closing path of the active door to operate the door-locking actuating element by turning that element and moving the adjustable drive means to drive forcibly the door-locking element into a locking engagement condition by turning that element in response to a force applied to the adjustable drive means less than the threshold value.

2. The combination of claim 1 in which the adjustable drive means reciprocates relative the support means to operate and release the door-locking element in response to a force less than the threshold value.

3. The combination of claim 2 in which the adjustable drive means fails to reciprocate and thus contracts in reponse to a force in excess of the threshold value due to an obstruction which prevents the door-locking element from locking the inactive door.

4. The combination of claim 3 including a strike assembly for receiving the door-locking element to lock the inactive door, and in which the obstruction is caused by a misalignment between the door-locking element and the strike.

5. The combination of claim 3 in which the adjustable drive means comprises a contractible spring-housing assembly including a compression spring contained with a housing formed of two telescoping tubes.

6. The combination of claim 5 in which the door-lock actuating element is coupled to one of the tubes and the door-locking element is coupled to the other tube.

7. The combination of claim 5 comprising a fire shield housing the adjustable drive means.

8. A locking mechanism to be applied to an inactive door of a set of active and inactive double doors coordinated so that the inactive door closes first relative to a frame followed by the closing of the active door, comprising adjustable drive means capable of lengthwise contraction along a first axis upon the application of a force between first and second separated locations on the adjustable drive means exceeding a threshold value and linear movement without substantial contraction upon the application of a force less than the threshold value, a door-lock actuating element coupled to the adjustable drive means at the first location with the door lock actuating element turning about a second axis different from the first axis, a door-locking element coupled to the adjustable drive means at the second location with the door locking element turning means at the second location with the door locking element turning about a third axis different from the first and second axes, and means adapted to support the adjustable drive means, the door-lock actuating element and the door-locking element at an edge of the inactive door with the door-locking actuating element projecting into the closing path of the active door to operate the door-lock actuating element by turning that element and moving the adjustable drive means to drive forcibly the door-locking element into a locking engagement condition by turning that element in response to a force applied to the adjustable drive means less than the threshold value, and in which the adjustable means contracts in response to an obstruction which prevents the door-locking element from locking the door.

9. A locking mechanism to be applied to an inactive door of a set of active and inactive double doors coordinated so that the inactive door closes first relative to a frame followed by the closing of the active door, comprising adjustable drive means capable of lengthwise contraction along a first axis upon the application of a first force between first and second separated locations on the adjustable drive means and also reciprocating movement without substantial contraction upon the application of a force less than the first force, a door-lock actuating element coupled to the adjustable drive means at the first location with the door lock actuating element pivoting about a second axis different from the first axis, a door-locking element coupled to the adjustable drive means at the second location with the door locking element pivoting about a third axis different from the first and second axes, and means adapted to support the adjustable drive means, the door-lock actuating element and the door-locking element on the inactive door with the door-lock actuating element projecting into the closing path of the active door to operate the door-lock actuating element by pivoting that element and moving the adjustable drive means to drive forcibly the door-locking element into a locking engagement condition by pivoting that element in response to a force applied to the adjustable drive means less than the first force, and in which the adjustable means contracts in response to the first force applied by an obstruction which prevents the door-locking element from locking the door.

10. The locking mechanism of claim 9 in which the first axis is a horizontal axis lying in the plane of the inactive door, the second axis is a vertical axis lying in the plane of the inactive door, and the third axis is normal to the plane of the inactive door.

11. The locking mechanism of claim 9 in which the inactive door swings on a fourth axis, the first axis is normal to the fourth axis and lies in the plane of the door, the second axis is generally parallel to and displaced from the fourth axis, and the third axis is normal to the first, second, and fourth axes.

12. The locking mechanism of claim 9 in which the adjustable drive means is a contractable spring-housing assembly formed by a pair of adjustable telescoping elements and a spring coupled to and tending to extend the telescoping elements.

13. The locking mechanism of claim 12 in which the spring-housing assembly comprises a pair of telescoping tubes containing the spring.

14. The locking mechanism of claim 13 comprising a metallic fire shield substantially enveloping the locking mechanism and having openings from which the door-lock actuating element and the door-locking element project in part to perform their respective actuating and locking functions.

* * * * *